United States Patent [19]

Baumstingl

[11] 4,045,939

[45] Sept. 6, 1977

[54] PROCESS FOR THE PRODUCTION OF A PACKAGING RECEIVING A STERILE LIQUID

[75] Inventor: Herbert Baumstingl, Tremelo, Austria

[73] Assignee: Papeteries de Belgique, Austria

[21] Appl. No.: 651,934

[22] Filed: Jan. 23, 1976

[51] Int. Cl.[2] ..... B65B 31/02; B65B 55/06; B65B 55/10

[52] U.S. Cl. ..... 53/22 A; 21/2; 53/28

[58] Field of Search ..... 53/22 A, 28, 167, 180 M, 53/182 M; 21/53, 58, 93, 99, 2

[56] References Cited

U.S. PATENT DOCUMENTS

| | | | |
|---|---|---|---|
| 2,918,770 | 12/1959 | Stocker | 53/180 M |
| 3,086,336 | 4/1963 | Rausing et al. | 53/180 M |
| 3,947,249 | 3/1976 | Egger | 53/167 X |

*Primary Examiner*—Robert Louis Spruill
*Attorney, Agent, or Firm*—Hill, Gross, Simpson, Van Santen, Steadman, Chiara & Simpson

[57] ABSTRACT

A method for the production of a pack in an enclosure containing a sterile liquid comprises a sterilization step and a pack forming and filling step. The sterilization step comprises sterilizing the enclosure by means of hot water under pressure, replacing the hot water by sterile cold water to cool the enclosure to ambient temperature, discharging the sterile water from the enclosure, drying the enclosure by continuously blowing warm compressed sterile air into the enclosure, and the pack forming and filling step comprises feeding a web of pack-forming material through the enclosure, forming the web into a longitudinally open tube as it is fed through the enclosure, sealing the open tube longitudinally and transversely and filling the sealed tube with the sterile liquid.

4 Claims, 3 Drawing Figures

PROCESS FOR THE PRODUCTION OF A PACKAGING RECEIVING A STERILE LIQUID

This invention relates to a method for the production in an enclosure of a pack containing a sterile liquid including the steps of feeding a flexible web of a pack-forming material though the enclosure, folding the web over in the enclosure to form it into a longitudinally open tube, welding the tube longitudinally and transversely to form individual packs, and filling the thus-formed packs in the enclosure with the sterile liquid.

Various methods of this kind are known in which the various portions of the enclosure are sterilized, under unconfined conditions, with expanded steam (maximum temperature 100° C), hot gas, a mixture of hot air and steam, or a mixture of hot air and a chemical sterilizing agent.

All these methods no doubt achieve good pasteurization but not complete sterility of the surfaces of the enclosure in contact with the sterile liquid because of the gaseous phase or vapor contained in the enclosure. Thus, complete destruction of bacterial spores is not achieved.

Sterilization by circulating hot water under pressure so as to avoid the gaseous phase in the form of vapor constitutes a better method of achieving complete sterilization of an enclosure in a machine for creating aseptic conditions; better contact with all the surfaces is achieved and furthermore the heat is distributed in a very efficient manner.

The present invention has for its object a new method for the production of a sterile pack containing a sterile liquid in which more complete sterilization is achieved. This new method enables the disadvantages of the known methods to be eliminated.

Accordingly the present invention provides a method for the production of a pack containing a sterile liquid, in an enclosure, the method comprising a sterilization step followed by a pack forming and filling step, the sterilization step comprising sterilizing the enclosure over a period of 10 to 40 minutes by means of water heated to a temperature of between 120° and 150° C, and at a pressure of between 3 and 5 kg/cm$^2$, replacing the hot water by sterile cold water to cool the enclosure to ambient temperature, discharging the sterile water from the enclosure and drying the enclosure by continuously blowing compressed sterile air into the enclosure at a temperature of between 60° and 70° C, and the pack forming and filling step comprising feeding a flexible web of pack-forming material made of at least one layer of synthetic plastics material that is weldable by pressure along a path through the enclosure, continuously injecting a serile gas into the enclosure while the web is being fed through the enclosure, sterlizing the two faces of the web, forming the web over in the enclosure to form it into a longitudinally open tube, feeding the tube downwardly past a filling pipe means which projects into the tube through the longitudinal gap in the tube, successively welding the tube first longitudinally and then transversely below the filling pipe means, introducing a sterile liquid into the portion of the longitudinally welded tube above the transverse weld, and separating the tube at the transverse weld to form individual liquid-containing packs.

Thus, the enclosure is completely sterilized and is maintained in the sterile condition during the forming of the web into a tube, during filling of the tube and during the final sealing of the tube so that perfectly sterile treatment is completely ensured.

In accordance with one preferred feature of the invention, hot water is passed through a valve for charging the tube with sterile liquid so that this valve is sterilized before the tube is filled with said sterile liquid.

In accordance with a further preferred feature, the flexible web is sterilized on both of its faces by being immersed in a bath of oxygenated water having an aqueous concentration of between 5 and 30% and heated to a temperature of between 40° and 60° C, and by heating the two faces in a sterile sealed casing, supersaturated with sterilizing vapor at a temperature of between 60° and 100° C.

This latter feature of the method enables the pipe and the valve to be sterilized in a sterile medium without the need for detaching them from the rest of the equipment. Sterilization in situ of these components is more rapid and more reliable and does not involve their being handled.

Other features and details of the invention will be seen from the following description of the annexed drawings which illustrate diagrammatically and by way of example only one form of construction of an installation for practising the method of the invention.

In these Figures identical components are designated by the same reference numeral.

Figure 1:
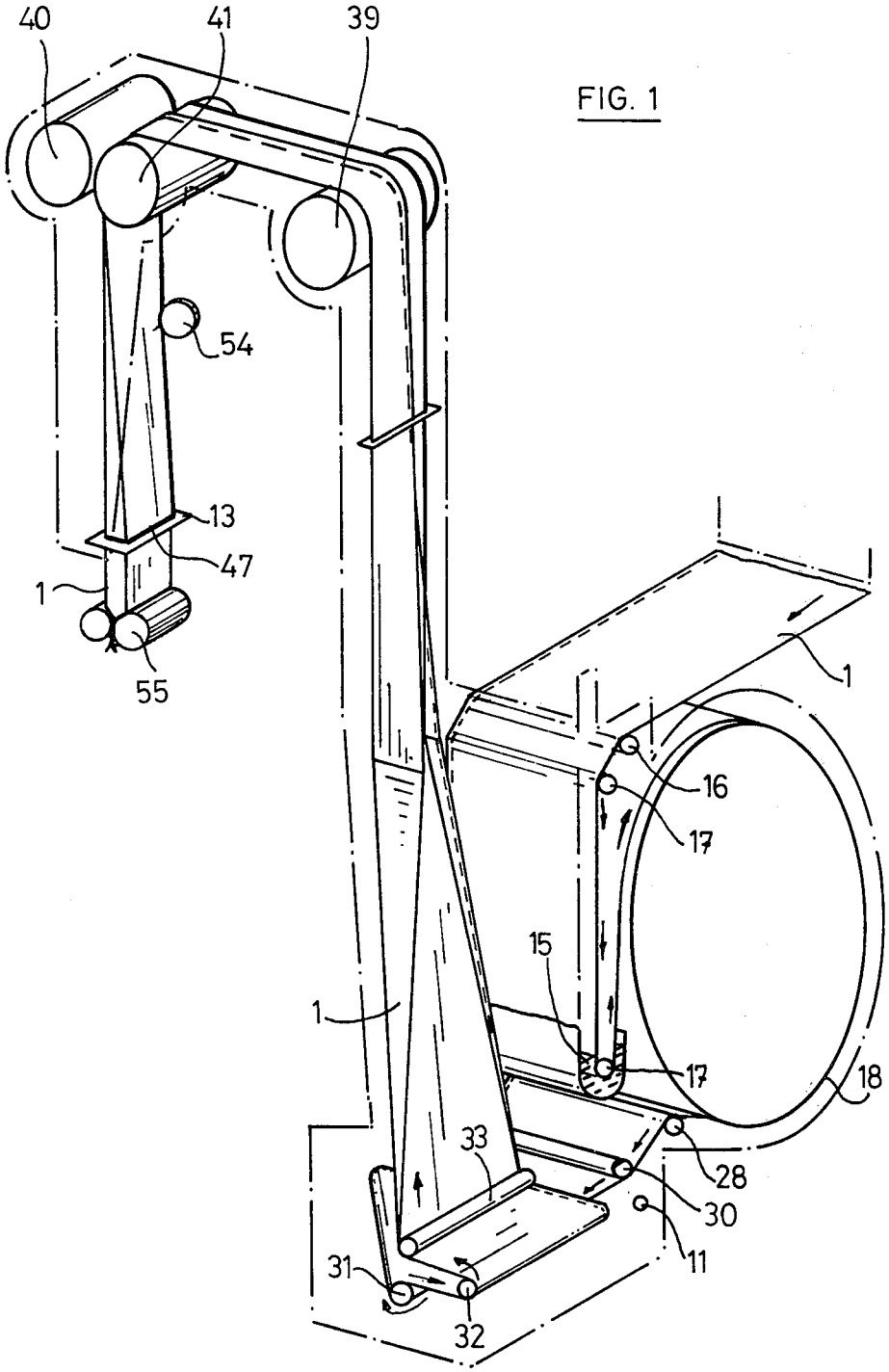
FIG. 1 is a diagrammatic perspective view of apparatus for carrying out the invention.

The illustrated apparatus is for producing sterile packs suitable for containing a sterile fluid, such as sterilized milk.

The packs are formed from a web 1 of flexible composite material including at least one layer of synthetic plastics material which can be hot pressure-welded and the web is provided in known manner with longitudinal and transverse fold lines or scoring.

A preferred composite material is constituted by several hot-laminated layers of material as follows:

- a first layer of polyethylene having a weight of 60 g/m$^2$ and forming the reverse face of the web,
- a first layer of aluminum foil having a thickness of 9$\mu$ or a weight of 25 g/m$^2$,
- a second layer of polyethylene having a weight of 20 g/m$^2$,
- a sheet of cardboard having a weight of 260 g/m$^2$, and
- a third layer of polyethylene having a weight of 15 g/m$^2$ and forming the front face of the web.

The apparatus shown comprises an enclosure 2 provided with means for closing it hermetically and for resisting an internal pressure higher than atmospheric pressure of at least 6 kg/cm$^2$. This enclosure 2 contains means 3 for sterilizing the flexible web 1, means 4 for folding the web longitudinally, means 5 for opening out the thus folded web to form a longitudinally open tube, a pipe 6 for filling this tube with sterile liquid, and means 7 for welding the tube longitudinally.

The enclosure 2 also includes means for admitting and discharging a sterilizing fluid — in this example water heated to a temperature of between 120° and 150° C at a pressure of between 3 and 5 kg/cm$^2$.

The means for admitting the hot water are advantageously constituted by the pipe 6 also used for filling the tube with sterile liquid. This filling pipe 6 is provided with a valve 8 which serves to control the flow of the sterilizing fluid admitted to the enclosure 2 for sterilizing the latter, and then to control the flow of sterile liquid introduced into and filling the tube 1. When the sterilizing liquid is introduced through the valve 8 and the pipe 6 for filling tube, these components are at the same time sterilized without it being necessary to detach them from the installation.

At its base the enclosure has a duct 9 provided with a valve 10 for discharging the hot water after sterilization of the enclosure.

To maintain the enclosure in a sterile condition during the conditioning and forming operations on the web and to dry it, it is filled with a sterile gas through a pipe 11. This gas, which may be sterile air for example, is kept in a compressed condition in the enclosure while it is passed through an inlet port 12 (in the form of a slot), is fed along the flexible web within the enclosure and leaves the enclosure through an outlet 13 for the tube 1. The above-mentioned inlet port 12 for the web and outlet for the tube are preferably of a size and shape that closely surround the cross-section of the web and of the filled tube respectively. The sterile gas, which is continuously discharged through the outlet, forms an aseptic barrier which prevents the entry of non-sterile air into the enclosure during the continuous travel of the web into the enclosure and during the continuous discharge of the filled tube therefrom.

The means for sterilizing the web 1 on its two faces comprise a stainless steel receptacle 14 containing a sterilizing bath 15, for example oxygenated water having an aqueous concentration of between 5 and 30%. This oxygenated water is kept at a temperature of between 40° and 60° C by means (not illustrated) for example a stainless steel electrical resistance element. Means, likewise not illustrated, are provided for supplying the receptacle with oxygenated water.

The web 1, introduced through the inlet slot 12, is passed over one or more parallel rollers 16 towards two direction-changing rollers 17 arranged parallel to one another and in the same vertical plane to guide the web vertically into the bath of heated oxygenated water and to ensure that vapor from the oxygenated water is directed on to the two faces of the web before and after its immersion in the bath. The apparatus for sterilizing the web also comprises means for heating the web after it has been immersed in the bath. These web heating means include a substantially concentric rotatable drum 18 mounted to rotate freely on a shaft 27 within a closed casing 19 having an inlet and outlet passages 26 and 29 respectively for the web 1. The drum 18 has an inner concentric wall 20 which delimits an annular space through which passes a heating fluid, for example circulated oil. This oil is heated to a temperature of between 90° and 95° C in a heating tank separate from the enclosure. For this purpose the inner wall 20 of the drum 18 is connected to the tank by an inlet pipe 21 and a discharge pipe 22 extending through two concentric hollow shafts 23 and 56 disposed around the central shaft 27 of the drum. These hollow shafts 23 and 56 are connected by two flexible pipes 24 and 25 to the annular space between the inner and outer walls of the drum. To establish connection between the hollow shafts 23 and 56 on the one hand and the pipes 24 and 25 respectively on the other, these shafts 23 and 56 each comprise a fixed part **23*a* and 56*a* respectively, mounted on the fixed casing of the drum, and a part 23*b* and 56*b* respectively each of which rotates with the drum, the moveable and fixed parts being connected to each other by sleeves 23*c* and 56*c*,** provided with joints such as ring seals.

After having been immersed in the bath of oxygenated water, the web 1 is picked up by the exterior of the drum 18 through the inlet passage 26 and is held against the heated exterior of the drum 18 over an arc of at least 270° the roller 17 located in the bath, and by a pressure roller 28 arranged parallel to the roller 17.

After having been heated to achieve its sterilization, the web 1 leaves the drum 18, moves through the outlet passage 29 and is guided by a direction-changing roller 30 towards the means 4 for folding the web 1 longitudinally.

The pipe 11 for admitting sterile gas into the enclosure is advantageously located near the position where the web, having been moistened by the oxygenated water, passes to the outlet of the casing 19, so that the sterile gas mixes with the residual vapours from the oxygenated water and dries the web 1.

Figure 2:
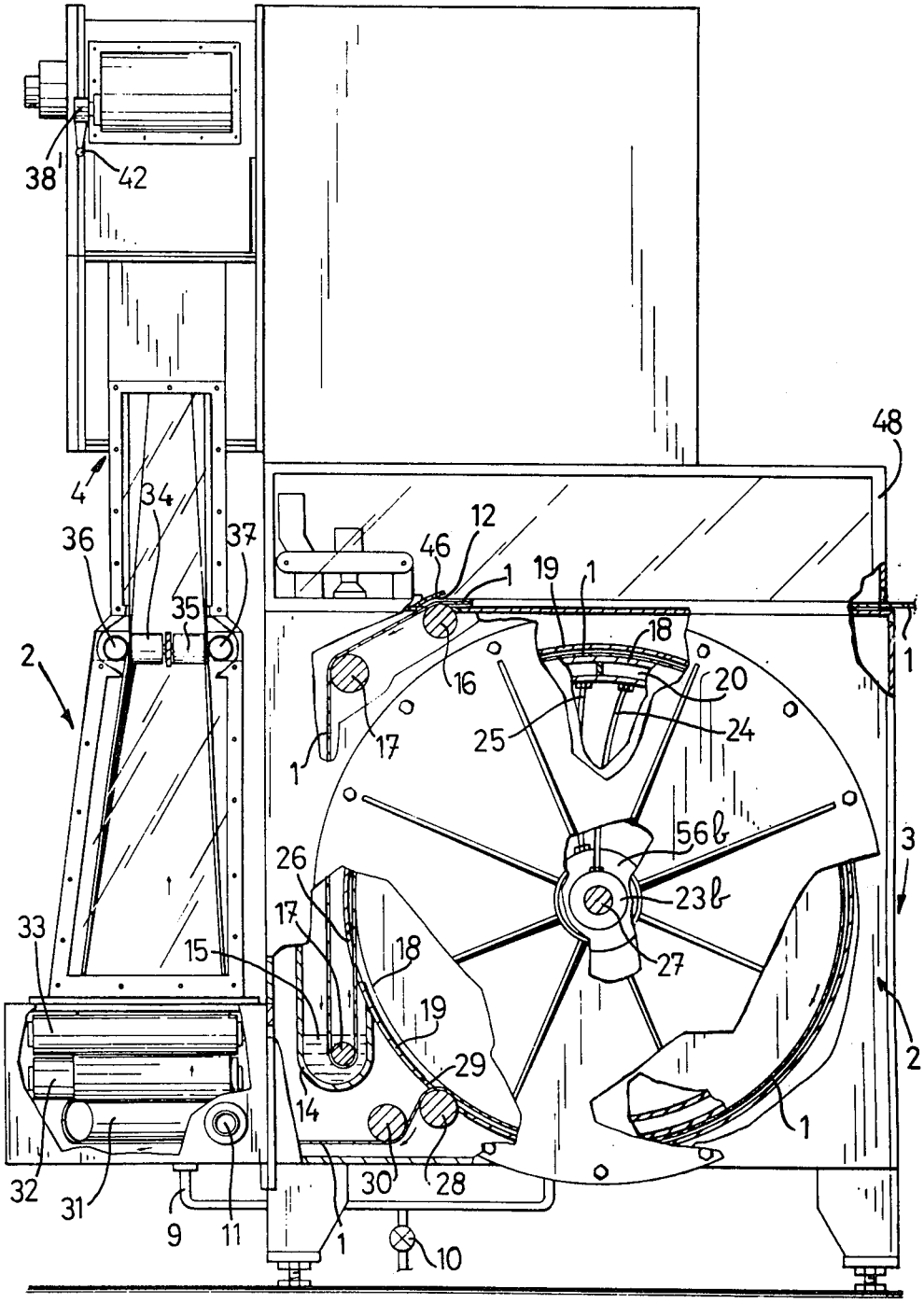
FIG. 2 is a partially fragmented side elevation of the apparatus shown in FIG. 1.
Figure 3:
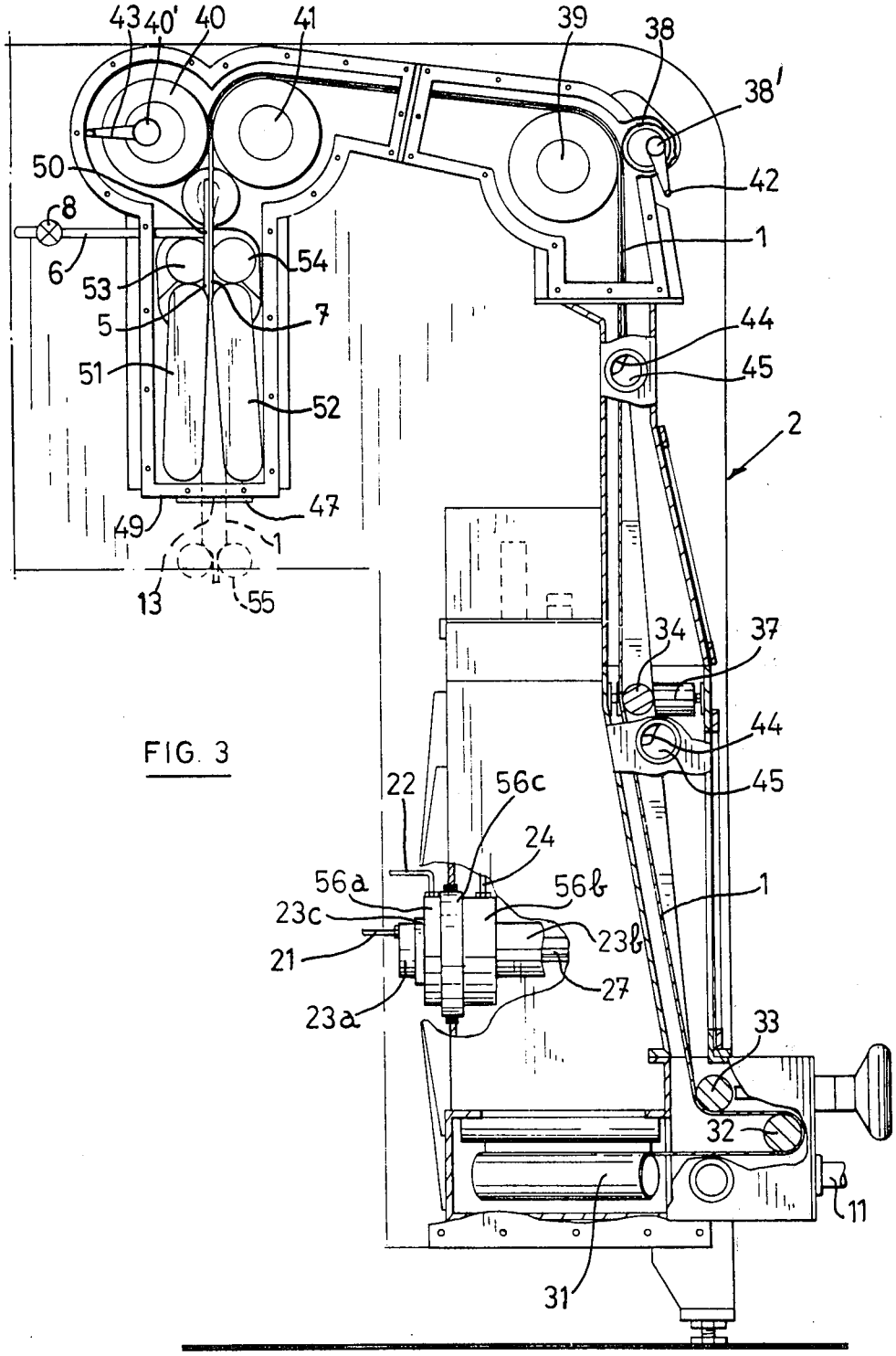
FIG. 3 is a partially fragmented front elevation of the apparatus shown in FIG. 2.

That portion of the enclosure that encloses the means 4 (FIG. 2) for longitudinally folding the web 1 is in the form of a sleeve or sheath which, at its bottom, communicates with the means 3 for sterilizing the web and, at its top, with that portion of the enclosure containing the means 5 for opening up the folded web 1. Further drying of the web 1 is carried out in this sheath under the action of the sterile air injected thereinto.

Contained at a base of the sheath are three guide rollers 31, 32 and 33 for turning the web 1 through 90° from the direction in which it enters the sheath. For this purpose, the roller 31 is adjustably mounted at an angle of 45° to the roller 30 and the rollers 32 and 33 which pass the web 1 towards the folding means 4 and which is disposed half-way up the sheath where the portions of the web 1 to be folded are turned through approximately 90°.

The folding means 4 comprises four rollers 34, 35, 36 and 37. The rollers 34 and 35 are arranged coaxially as an extension one of the other, at a distance apart corresponding to the unfolded portion of the web delimited by the fold lines previously provided on the web. The rollers 36 and 37 are arranged parallel to each other and at right-angles to the rollers 34 and 35 at the free end of the first rollers in the horizontal plane of the latter. The rollers 34 and 35 are spaced from each other by a distance corresponding substantially to the thickness of the vertically folded web 1 at this position.

The enclosure 2 also contains, at a point along the ascending portion of the web 1, a first pair of rollers 38 and 39, between which the portions of the web 1 to be folded are folded through an angle of approximately 180°. The roller 39 passes the folded strip between a second pair of drive rollers 40 and 41 mounted to the rear (downstream) of the previously mentioned pair 38 and 39 along a descending portion of the path of travel of the web 1 before the web 1 opened up. The rollers 38 and 40 are concentrically mounted on eccentrically mounted support shafts 38' and 40' respectively and are provided with manual operating levers 42 and 43 which are mounted on the shafts 38', 40' of the rollers 38 and 40 and which, when rotated, cause the rollers 38 and 40 to move towards the respective cooperating rollers 39 and 41 respectively so as to apply pressure to the web and to cause it to be advanced manually when it is brought into the enclosure.

The manual feeding of the web 1 into the enclosure 2 is further facilitated by a number of hermetically sealed gloves accessible from the exterior of the enclosure 2 and fitted in orifices 44 in the wall of the enclosure. These orifices 44 are provided with gaskets 45 which apply a counter-pressure which the enclosure is being pressurised, so that they prevent the gloves from being ejected outwards through these orifices 44 under the effect of the internal pressure obtaining in the enclosure 2. These gaskets 45 are constituted by discs which are removably secured to the wall of the enclosure 2.

Furthermore, the inlet slot 12 for admitting the web 1 to the enclosure 2, and the outlet 13 for enabling the filled tube to pass out of the enclosure 2 are likewise provided with disc gaskets 46 and 47 which are removably fitted on the walls 48 and 49 respectively of the enclosure 2 and which temporarily seal the enclosure while hot sterilizing fluid (water under pressure) is being passed into it.

The means 5 for opening up the web 1 to form a longitudinally open tube comprises a vertical separating plate 50 fixed in the enclosure 2 on the bottom wall thereof below the second pair of rollers 40 and 41 disposed along the downward path of the folded web 1. When the web 1 is fitted in position in the enclosure 2, the folded portions of the web 1 are separated by hand using gloves and are placed one on each side of the plate 50. Then, when the web 1 advances, this plate 50 opens up the folded web 1 to form it into a longitudinally open tube. Two stainless steel belts 51 and 52, the tension of which is variable, which move in the feed direction of the endless tube and the spacing between which is regulatable, are disposed one on each side of the plate 50; these belts 51 and 52 diverge from each other in the downward direction and contain the opened-up walls of the tube while it is being filled with sterile liquid.

The means 7 for the longitudinal welding of the tube comprises two pressure rollers 53 and 54 which are located in the enclosure 2 along the descending portion of the web 1, to the rear of the plate 50 and of the filling pipe 8, between the pair of rollers 40 and 41 and the pair of belts 51 and 52. These pressure rollers 53 and 54 weld the longitudinal edges of the tube so as to close it in the longitudinal direction, and they seal in the sterile liquid which is introduced into the longitudinally closed portion of the tube.

In the customary manner, an apparatus 55 for transversely welding the tube and for cutting it up into separate packs is provided below the wall 49 of the enclosure 2, the packs undergoing finishing treatment in a following station.

Also provided is a sensor for controlling the level of the sterile liquid in the tube.

The hot sterile air is obtained by heating atmospheric air to a temperture of between 300° and 350° C by electrical resistance heating elements and by passing it through a metallic filter made of fritted steel to bring the air to uniform heat and to maintain it at a temperature of 300°-350+ C for at least one second. The hot sterile air is then passed through a water-column cooler to obtain the required temperature before it is passed into the aseptic enclosure.

In accordance with the invention the method, is carried out in the following manner. Before the web 1 is introduced into the enclosure 2, the valve 8 and the filling pipe 6 are simultaneously sterilized. For this purpose the enclosure 2 is rendered air-tight by sealing the web inlet slot 12 and the outlet passage 13 by means of gaskets 46 and 47, and a counter-pressure gasket 45 is placed over the orifices 44 through which the hermetically sealed gloves can be reached. Water heated to a temperature of between 120° and 150° C and at a pressure of between 3 kg/cm$^2$ and 5 kg/cm$^2$ is then introduced through the valve 8 and through the filling pipe 6 and the hot water is caused to circulate continuously in the enclosure 2 for a period of 20 to 40 minutes. The installation is then cooled to ambient temperature by the introduction of cold sterile water, and the latter is discharged by gravity through the pipe 9 via the valve 10.

To keep the enclosure 2 sterile, slightly pressurized sterile air, is blown continuously into the enclosure 2 and the sterile air is continuously discharged though the inlet slot 12 and the 13. The slightly pressurized air is brought to a temperature of between 60° to 70° C before being blown into the enclosure. The receptacle 14 is filled with oxygenated water at an aqueous concentration od between 5 and 39% and previously heated to a temperature of between 40° and 60° C, this temperature being maintained by a suitable heating means, for example an electrical resistance heating element at the bottom of the bath. The drum 18 is heated to a temperature of between 90° and 95° C by circulating hot oil in the annular space formed between the inner and outer walls of the drum and the composite web 1, having been previously scored longitudinally and transversely by means of a known device (not illustrated) is then introduced into the aseptic enclosure through the inlet slot 12. The web 1 is guided by the rollers 16 and 17 and passes into the bath of hot oxygenated water and is picked up through the opening 26 by the heated outer surface of the rotatable drum 18. After having travelled with the drum through an arc of more than 270°, the web, having been brought to a relatively dry condition, is picked up by the rollers 28 and 29, is then turned through 90° by the rollers 31, 32 and 33, and is thereafter guided into the sheath-like portion of the enclosure 2. When the web reaches the enclosure 2 it is further dried and it is folded along the longitudinal fold lines or scoring by the action of the folding rollers 34, 35, 36 and 37. The folded web 1 then passes between the pairs of rollers 38, 39 and 40, 41 and enters the descending portion of the enclosure 2 where the web 1 is opened up by the plate 50 into the form of a longitudinally open tube. The open tube is then welded longitudinally between the pressure rollers 53 and 54 and is filled with sterile liquid by the filling pipe 6 which moves downwards into the welded tube.

The sterile liquid filled tube is continuously discharged from the enclosure 2 through the outlet 13 and then, in the customary manner, it is welded transversely and is cut up into separate lengths in the form of pouches. The pouches are thereafter shaped into parallelpiped packings at a following station.

It is obvious that the invention is not exclusively limited to the embodiments illustrated, and that modifications can be made as regards the form, disposition and constitution of certain of the components used in carrying out the invention, without departing from the scope of the invention provided that these modifications fall within any of the following claims.

I claim:

1. A method for the production in a sole enclosure of a pack containing a sterile liquid, the method comprising a sterilization step followed by a pack forming and filling step, said sterilization step comprising filling entirely the enclosure with previously heated water to a temperature of between 120° and 150° C and at a pressure of between 3 and 5 kg/cm$_2$, circulating said heated water over a period of 10 to 40 minutes, replacing the hot water by sterile cold water to cool the enclosure to ambient temperature, discharging the sterile water from the enclosure and drying the enclosure by continuously blowing compressed sterile air into the enclosure at a temperature of between 60° and 70° C, and said pack forming and filling step comprising feeding along a path through the enclosure a flexible web of pack-forming material made of at least one layer of synthetic plastics material that is weldable by pressure, continuously injecting a sterile gas into the enclosure while the web is being fed through the enclosure, sterilizing the two faces of the web, folding the web over in the enclosure to form it into a longitudinally open tube, feeding said tube downwardly past a filling pipe means which projects into the tube through the longitudinal gap in the tube, and successively welding the tube first longitudinally and then transversely below said filling pipe means, introducing a sterile liquid into the portion of the longitudinally welded tube above said transverse weld, and separating the tube at said transverse weld to form individual liquid-containing packs.

2. A method as claimed in claim 1 in which said sterilization step includes passing sterile hot water into said filling pipe means tube through a valve for filling said pipe means and the entire enclosure with sterile hot water so as to sterilize said valve means before filling said pipe means and the entire enclosure with said sterile liquid.

3. A method as claimed in claim 1 in which the flexible web is also sterilized on both of its faces by being immersed in a bath of oxygenated water having an aqueous concentration of between 5 and 30% and at a temperature of between 40° and 60° C, and by heating said two faces in a sterile sealed casing, super-saturated with sterilizing vapor at a temperature of between 60° and 100° C.

4. A method as claimed in claim 3, in which an inner face of the web is heated in contact with a heating surface of a drum fitted in the casing, and the other face of said web is heated by radiation from the inner wall of the casing.

* * * * *

UNITED STATES PATENT AND TRADEMARK OFFICE

CERTIFICATE OF CORRECTION

PATENT NO. : 4,045,939
DATED : Sept. 6, 1977
INVENTOR(S) : Herbert Baumstingl

It is certified that error appears in the above-identified patent and that said Letters Patent are hereby corrected as shown below:

[75] Inventor: Herbert Baumstingl
Tremelo, Belgium

[73] Assignee: Papeteries de Belgique
Bruxelles, Belgium

Signed and Sealed this

*Twenty-second* Day of *January 1980*

[SEAL]

*Attest:*

SIDNEY A. DIAMOND

*Attesting Officer*

*Commissioner of Patents and Trademarks*